US009532687B2

(12) United States Patent
Sollami

(10) Patent No.: US 9,532,687 B2
(45) Date of Patent: Jan. 3, 2017

(54) TOILET AIR FILTRATION SYSTEM

(76) Inventor: Jimmie L. Sollami, Herrin, IL (US)

( * ) Notice: Subject to any disclaimer, the term of this patent is extended or adjusted under 35 U.S.C. 154(b) by 1266 days.

(21) Appl. No.: 13/447,373

(22) Filed: Apr. 16, 2012

(65) Prior Publication Data

US 2013/0269091 A1 Oct. 17, 2013

(51) Int. Cl.
*E03D 9/04* (2006.01)
*A47K 13/30* (2006.01)
*E03D 9/05* (2006.01)

(52) U.S. Cl.
CPC ..... *A47K 13/307* (2013.01); *E03D 9/05* (2013.01)

(58) Field of Classification Search
CPC ..... E03D 9/05
USPC ..... 4/213, 217
See application file for complete search history.

(56) References Cited

U.S. PATENT DOCUMENTS 2,238,461 A * 4/1941 Carman ..... E03D 9/052 4/213
3,474,470 A * 10/1969 Watson ..... A47K 13/12 16/337
6,167,576 B1 1/2001 Sollami
6,233,750 B1 * 5/2001 Donald ..... E03D 9/007 4/213
6,298,500 B1 10/2001 Sollami
6,360,377 B2 3/2002 Sollami
6,772,449 B1 * 8/2004 Wolfe ..... A47K 13/307 4/213
8,657,086 B2 * 2/2014 Iwata ..... A47K 13/12 16/240
2001/0054195 A1 * 12/2001 Simpson ..... E03D 9/05 4/213
2006/0031979 A1 * 2/2006 Johnson ..... E03D 9/05 4/213
2006/0064808 A1 * 3/2006 Vierkant ..... A47K 13/26 4/236
2007/0256219 A1 * 11/2007 Ellinger ..... E03D 9/052 4/213
2015/0182081 A1 * 7/2015 Gray ..... A47K 13/12 4/236

* cited by examiner

*Primary Examiner* — Huyen Le
(74) *Attorney, Agent, or Firm* — Pitts & Lake, P.C.

(57) ABSTRACT

A filtration system for a toilet including a fan assembly having an air flow channel in fluid communication with a toilet bowl, a housing interposing the toilet bowl and the fan assembly to receive a filter unit therein such that the filter unit is in fluid communication with the air flow channel. A controller can selectively activate the fan assembly in response to various signals.

22 Claims, 9 Drawing Sheets

TOILET AIR FILTRATION SYSTEM

BACKGROUND OF THE INVENTIVE CONCEPT

1. Field of Inventive Concept

The present general inventive concept relates to the field of toilet ventilation. More specifically, the present general inventive concept relates to a filtration system for removing odors, bacteria, and/or particulate matter from air drawn from a toilet bowl.

2. Description of the Related Art

The benefit of ventilating a toilet bowl has long been recognized. Accordingly, many devices have been developed to provide such a function. Of interest in the present disclosure is a filtration system that is used to remove odors, bacteria, and/or particulate matter from the air in and around the toilet bowl.

BRIEF SUMMARY OF THE INVENTIVE CONCEPT

The present general inventive concept provides filtration systems to filter odor, bacteria, and/or particulate matter emanating from a toilet.

Example embodiments of the present general inventive concept can be achieved by providing a filtration system to filter air from a toilet bowl including an air flow channel and fan assembly in fluid communication with a toilet bowl, a housing interposing the toilet bowl and the fan assembly, the housing having a filter receptacle to receive a filter unit therein, the filter unit being in fluid communication with the air flow channel, and a controller to selectively activate the fan assembly such that, when activated, the fan assembly draws air from the toilet bowl and through the filter unit to exhaust the air out of the air flow channel.

Example embodiments of the present general inventive concept can also be achieved by providing a filtration system to filter air from a toilet bowl including a housing having an inlet port and an exhaust port and a filter receptacle interposing the inlet port and the exhaust port to receive a filter unit therein, a conduit having a first end and a second end, the first end securable adjacent to a toilet bowl, the second end connected to the inlet port, a fan assembly in fluid communication with the toilet bowl such that the filtration system defines an air flow channel to draw air from the toilet bowl through the conduit into the inlet port, through the filter unit, and through the exhaust port, and a controller to selectively activate the fan assembly.

Example embodiments of the present general inventive concept may further include a ventilated toilet seat pivotally coupled to the toilet bowl by a toilet seat hinge, the toilet seat hinge including an inlet portion to engage with the toilet seat and an exhaust portion in fluid communication with the air flow channel to deliver air from an underside of the ventilated toilet seat to the air flow channel.

A filtration system may also include a ventilated toilet seat coupled to the toilet bowl using an elliptical member to resistively inhibit the toilet seat from pivoting when the toilet seat is substantially raised relative to the toilet bowl, and to freely allow the toilet seat to pivot when the toilet seat is substantially lowered relative to the toilet bowl.

A filtration system may also include a toilet seat that includes an intake to receive the toilet seat hinge, the intake in fluid communication with the toilet bowl, the hinge including an exhaust portion coupled to the conduit, whereby the fan assembly, when activated, draws air from the toilet bowl through the toilet seat hinge and into the air flow channel. In some embodiments, the inlet portion is a noncircular member to resistively hold the ventilated toilet seat in an elevated position with respect to the toilet. In some embodiments, the intake is a non-circular member to resistively hold the ventilated toilet seat in an elevated position with respect to the toilet.

A filtration system can also include a received filter unit that is removably secured within the filter receptacle, and a filtration media contained within an interior volume of the filter unit, the filtration media to collect odors, bacteria and/or particulate matter when air passes through said filtration media. In some embodiments, the filtration media traps and kills bacteria that enter the filter unit.

In various example embodiments of the preset general inventive concept, the fan assembly is interposed between the inlet port and the exhaust port of the housing.

Example embodiments of the present general inventive concept can also be achieved by providing a fitting to the conduit and the housing.

In some embodiments, a fitting is provided having a first part coupled to the conduit and a second part coupled to the housing, the first part and second part cooperatively mating to secure the conduit to the housing in a substantially air tight engagement. In some embodiments, the fitting is a connector that is selectively coupled to the conduit, to the housing, or both.

Example embodiments of the present general inventive concept can be achieved by providing a filtration system including a filter unit having an inlet and an outlet such that air is drawn from the toilet bowl through the conduit, through the inlet port of the housing, into the filter unit inlet, through the filter unit outlet, and through the exhaust of the housing. In some embodiments, the filter unit inlet and outlet define a plurality of openings sized to permit air containing odors, bacteria, and/or particulate matter to enter and exit the filter unit's interior while substantially preventing the filtration media from exiting the filter unit's interior. In some embodiments, the filter unit includes a sealing material on an exterior surface thereof, and the housing includes a sealing material on an interior surface thereof to receive the filter unit in a manner such that substantially all moving air travels through the filter unit.

Example embodiments of the present general inventive concept can include a fan assembly located outside the housing. In some embodiments, the air flow channel is further defined by a fan receptacle, the fan receptacle being selectively connectable to the housing and to the fan assembly. The fan assembly can be a preexisting fan assembly, such as a ceiling fan or exhaust system.

Example embodiments of the present general inventive concept can further include an activation switch communicating with the controller to selectively activate or deactivate the fan assembly. In some embodiments, the activation switch is located on or in the housing. The activation switch can be located on a remote control. The activation switch can be influenced by a light sensor, a motion sensor, and/or a pressure sensor.

Additional features of the present general inventive concept will be set forth in part in the description which follows, and, in part, will be obvious from the description, or may be learned by practice of the present general inventive concept.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION OF THE INVENTIVE CONCEPT

Figure 1:
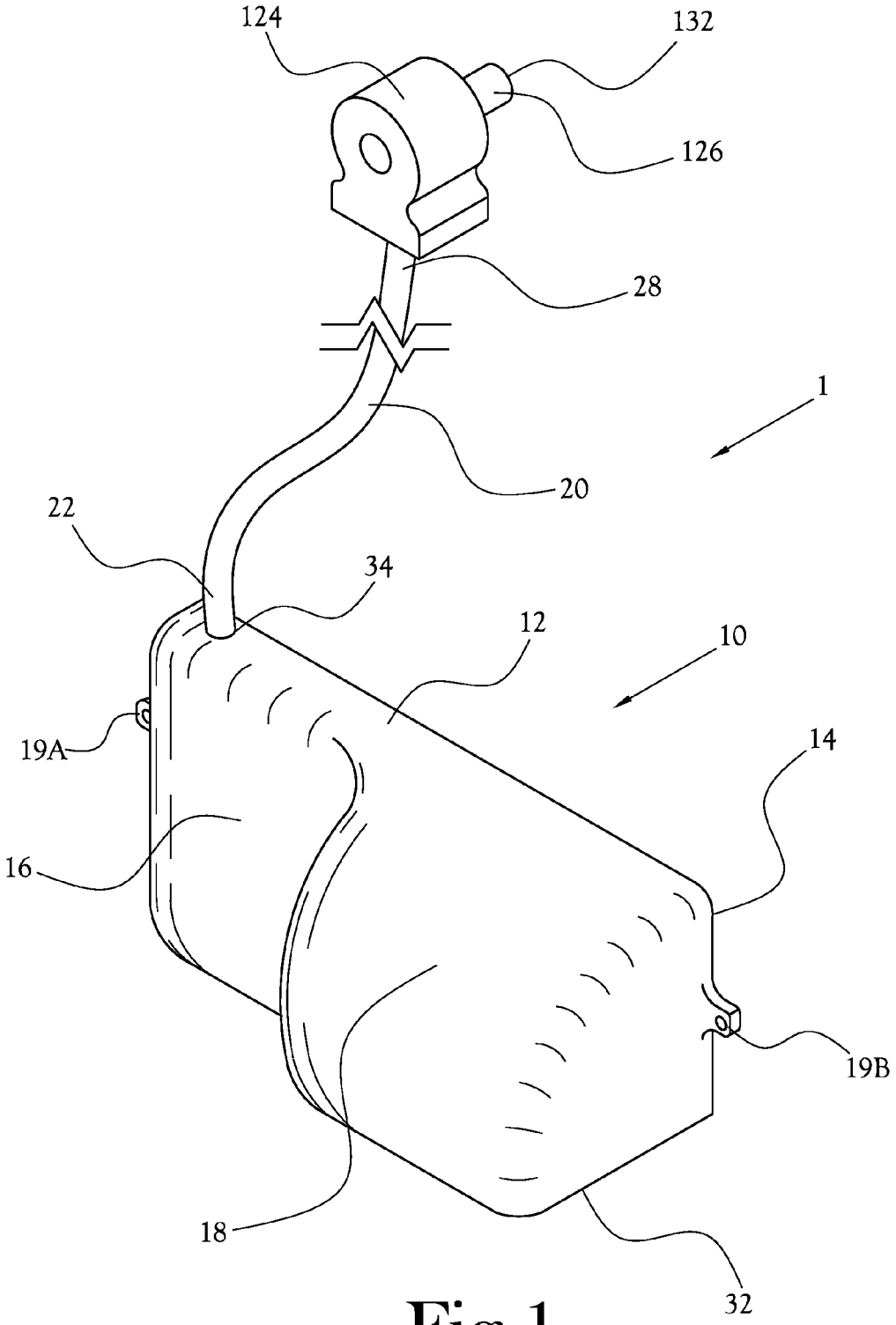
FIG. 1 illustrates a perspective view of an example embodiment of the present general inventive concept.

A filtration system for use with a ventilated toilet seat incorporating various features of the present general inventive concept is illustrated generally at 1 in FIG. 1. The filtration system 1 is designed for filtering air drawn from a toilet 72 using a ventilated toilet seat 76, such as the ones described in detail in U.S. Pat. No. 6,167,576 and U.S. Pat. No. 6,298,500, the contents of which are incorporated herein by reference. The filtration system 1 further includes a housing 10 designed to be mounted on a wall behind the toilet 72 and under an associated tank 74, when provided, such that a substantial portion of the housing 10 is concealed from view. It will be noted that in commercial use, toilets 72 are often provided with a water supply from a remote location and a resident-type tank 74, as illustrated, is not associated with the toilet 72.

Figure 2:
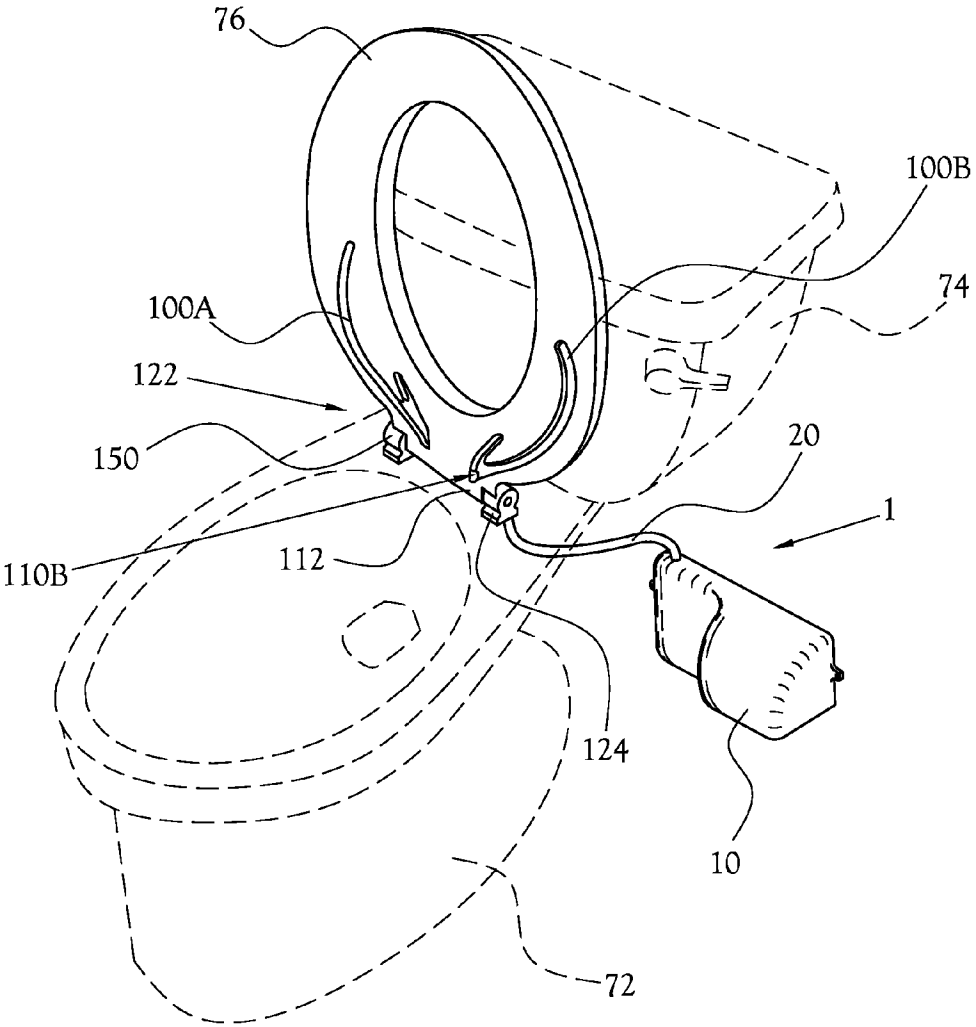
FIG. 2 illustrates a perspective view of an example embodiment of the present general inventive concept in fluid communication with a ventilated toilet seat.

As illustrated in FIG. 2, the housing 10 can be configured to be mounted on a wall behind a toilet 72 and under the toilet tank 74 such that it is substantially concealed from view. Although illustrated as being disposed on the right hand side of the toilet 72, it will be understood that the housing 10 of the present general inventive concept may be modified to be positioned behind either side of the toilet 72. At least one conduit 20 can be attached to the housing 10 to extend to the ventilated toilet seat 76. In the illustrated embodiment, one such conduit 20 is provided for drawing contaminated air from a discrete evacuation channel 100B defined by the toilet 72 or toilet seat 76. However, it will be understood that in environments wherein two evacuation channels are provided, two conduits or a "Y" shaped conduit can be used.

A front view of an example embodiment housing 10 is illustrated at FIG. 1. A front panel 12 having two depth segments is connected to a rear panel 14 and a bottom panel 32 to define an interior volume 17 within the housing 10 of the illustrated embodiment. Specifically, present embodiment includes a front panel 12 having a first end segment 16 with curved side and top portions to connect with the rear panel 14, and defines an interior volume when also connected to the bottom panel 32. The second end segment 18 has curved side and top portions to connect with the rear panel 14 and defines a larger interior volume, with respect to the volume defined by the first end segment 16, when also connected to the bottom panel 32. It will be understood that the present general inventive concept is not limited to the specific shape of the housing member discussed above.

In the illustrated embodiment, one conduit receptacle, or inlet port 34 is defined near the top of the first depth segment of the housing's front panel for receiving the proximal end 22 of the conduit 20. It will be understood that the inlet port can include two conduit receptacles 34 in situations wherein two conduits 20 are used.

The housing 10 defines an air flow channel comprising a first end 36 and a second end 38 separated by a filter receptacle 50. The first end 36 can have a first depth dimensioned to be received behind a conventional toilet 72. In some embodiments, the first end 36 of the housing 10 defines a depth of approximately three inches (3"). As illustrated and as described above, the conduit receptacle 34 is disposed near the top of the front panel proximate the first end 36. By disposing the first end 36 of the housing 10 behind the toilet 72, with the conduit receptacle 34 defined therein, the conduit 20 is directly routed from underneath the toilet seat 76 to a point behind the toilet 72, under the tank 74, and above the housing 10, thereby concealing a substantial portion of the conduit 20. The second end 38 of the housing 10, in the illustrated embodiment, defines a larger depth in order to better facilitate maintenance of the interior components of the housing 10, as further described below. In the example embodiment, the depth of the second end 38 of the housing 10 is approximately six and one-half inches (6½"), although the present general inventive concept is not limited to any particular dimension. It is possible that the depth of the second end 38 of the housing 10 be less than the dimension from the front of the tank 74 to the wall such that the housing 10 can remain substantially concealed behind the toilet. Further, the length of the housing 10 can be dimensioned to be substantially received under the tank 74. Because these dimensions may be varied in accordance with sound engineering judgment, it will be understood that the present general inventive concept is not limited to these dimensions.

As illustrated, the front panel 12 can include extension members 19A, 19B on either side to accommodate installing the housing against a wall. In this embodiment, the housing 10 is mounted to a wall in a conventional fashion, such as with wall anchors. The selected mounting device will depend upon the application, for example, taking into consideration the need for security from theft or vandalism. However, it will be understood that the present general inventive concept is not intended to be limited by the specific type of conventional fastener chosen to mount the housing 10.

In some embodiments, a fitting or connector is provided to couple the proximal end of the conduit 20 to the housing 10. The fitting may be fabricated from a rigid material such as metal, stainless steel, and/or plastic and includes a means for coupling the conduit 20 to the housing 10. The housing 10 may contain a conduit receptacle 34 that includes a corresponding means for receiving the fitting such that the fitting is mechanically mated with the conduit receptacle 34 to create a substantially air tight engagement. In some embodiments, a connector is provided that is selectively attachable to the housing 10, to the conduit 20, or both, thereby facilitating a substantially air tight engagement. In other embodiments, the connector can be integrally formed with the conduit 20, and can be selectively attachable to the housing's conduit receptacle 34, or vice versa, to facilitate a substantially air tight engagement.

Figure 3:
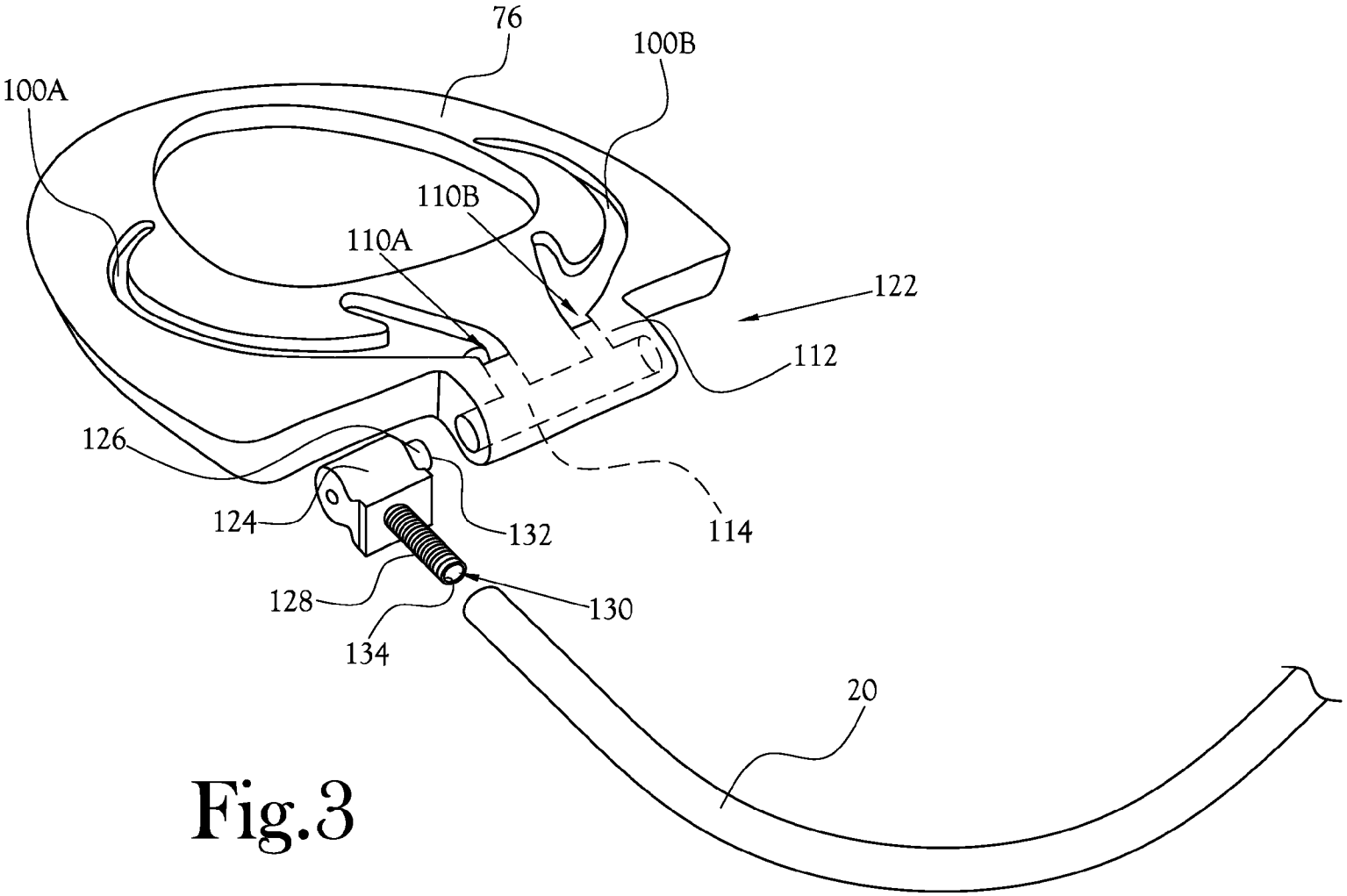
FIG. 3 illustrates an exploded view of an example embodiment of the toilet seat hinge and conduit engaging an inverted ventilated toilet seat.

Referring to FIGS. 2-3, the distal end 28 of the conduit 20 is connected to the ventilated toilet seat 76 by a toilet seat hinge 124. As illustrated, a ventilated toilet seat 76 defines two outlets 110A and 110B between the evacuation channels 100A and 100B and a hinge receptor 112. In this embodiment, a hinge receptor 112 is defined by the ventilated toilet seat 76 and extends from the back thereof. The hinge receptor 112 defines a through opening 114, or intake, for rotatably receiving the inlet portion 126 of a toilet seat hinge 124. The toilet seat hinge 124 is provided for mounting the ventilated toilet seat 76 to a conventional toilet 72. To this extent, the toilet seat hinge 124 defines a threaded exhaust post 128 for being received in an opening defined by the conventional toilet 72 for mounting a seat thereto. The toilet seat hinge 124 further defines an inlet portion 126 configured to be received within the ventilated toilet seat hinge receptor 112. It will be understood that the inlet portion 126 and the threaded exhaust post 128 may be individually formed and secured together in a conventional manner, or may be integrally formed as illustrated. The toilet seat hinge 124 further defines an internal conduit 130 having an intake 132 on the inlet portion 126 thereof and an exhaust 134 at the distal end of the threaded exhaust post 128. The exhaust post 128 receives the distal end 28 of the conduit 20. Thus, the internal conduit 130 is disposed to establish fluid communication between the evacuation channel 100A of the ventilated toilet seat 76, through the outlet 110A, through the through opening 114, through the internal conduit 130 of the toilet seat hinge 124, through the conduit 20, and into the interior volume 17 of the housing 10. In the currently illustrated embodiment, the hinge assembly 122 includes one toilet seat hinge 124 and one standard hinge 150 that cooperatively secure the ventilated toilet seat 76 to the toilet 72 and permit the ventilated toilet seat 76 to rotate around the standard hinge 150 and the inlet portion 126 of the toilet seat hinge 124. In an alternate embodiment where the ventilated toilet seat 76 contains two independent evacuation channel outlets (and a divided through opening), two ventilated toilet seat hinges 124 can comprise the hinge assembly 122.

In the exemplary embodiment, the toilet seat hinge 124 and hinge receptor 112 interact to resistively hold the ventilated toilet seat 76 in an elevated position. As used herein, resistively hold refers to a still position achieved by a toilet seat after having been rotatably elevated with respect to a toilet bowl in such a manner as to substantially prevent the toilet seat 76 from rotating back down without an external force being applied. Importantly however, the resistance diminishes when the toilet seat is lowered to the down position. To that extent, in one example embodiment, the hinge receptor's through opening 114 is egg-shaped. Stated differently, the through opening 114 designed for receiving the inlet portion 126 of the toilet seat hinge 124 may be shaped like an ellipsis such that it is not a perfect circle. Likewise, in one example embodiment, the inlet portion 126 of the toilet seat hinge is shaped as an elliptic cylinder. Stated differently, the inlet portion 126 of the toilet seat hinge 124 may be a generally cylindrical member with an elliptical cross section. Thus, when a user wishes to rotate the ventilated toilet seat 76 about the toilet seat hinge 124, the inlet portion 126 of the toilet seat hinge 124 compresses against the internal wall of the hinge receptor's through opening 114, thereby resistively holding the raised ventilated toilet seat 76 with respect to the toilet 72, yet also freely releasing the toilet seat 76 when external force is applied to lower the toilet seat 76 to the down position. It will be understood that either or both the through opening 114 and the inlet portion 126 may be shaped to compress against the other during rotation of the toilet seat to facilitate the resistive holding of the toilet seat 76. One of skill in the art will recognize that the present general inventive concept is not limited to the particular cross sectional shape discussed herein, as other, noncircular shapes may be used to resistively inhibit the toilet seat from pivoting when the toilet seat is substantially raised relative the toilet bowl without departing from the scope or spirit of the present general inventive concept.

In the exemplary embodiment, the inlet portion 126 compresses against the internal wall of the through opening 114 during rotation to an extent that the ventilated toilet seat 76 is resistively held starting at an angle of elevation substantially equal to about sixty (60) degrees with respect to the toilet bowl. Stated differently, when the toilet seat 76 is at an angle of elevation less than about sixty (60) degrees, the elliptical member 126 permits the toilet seat 76 to freely rotate, however when the toilet seat 76 is elevated past sixty (60) degrees, it becomes resistively held in the elevated position by the elliptical member 126. In other embodiments, resistive holding begins at about a seventy-five (75) degree angle. It will be understood that the specific angles where the toilet seat 76 is resistively held are not limited to those which are disclosed herein, and other angles may be chosen with sound engineering judgment to achieve similar results.

Figure 4:
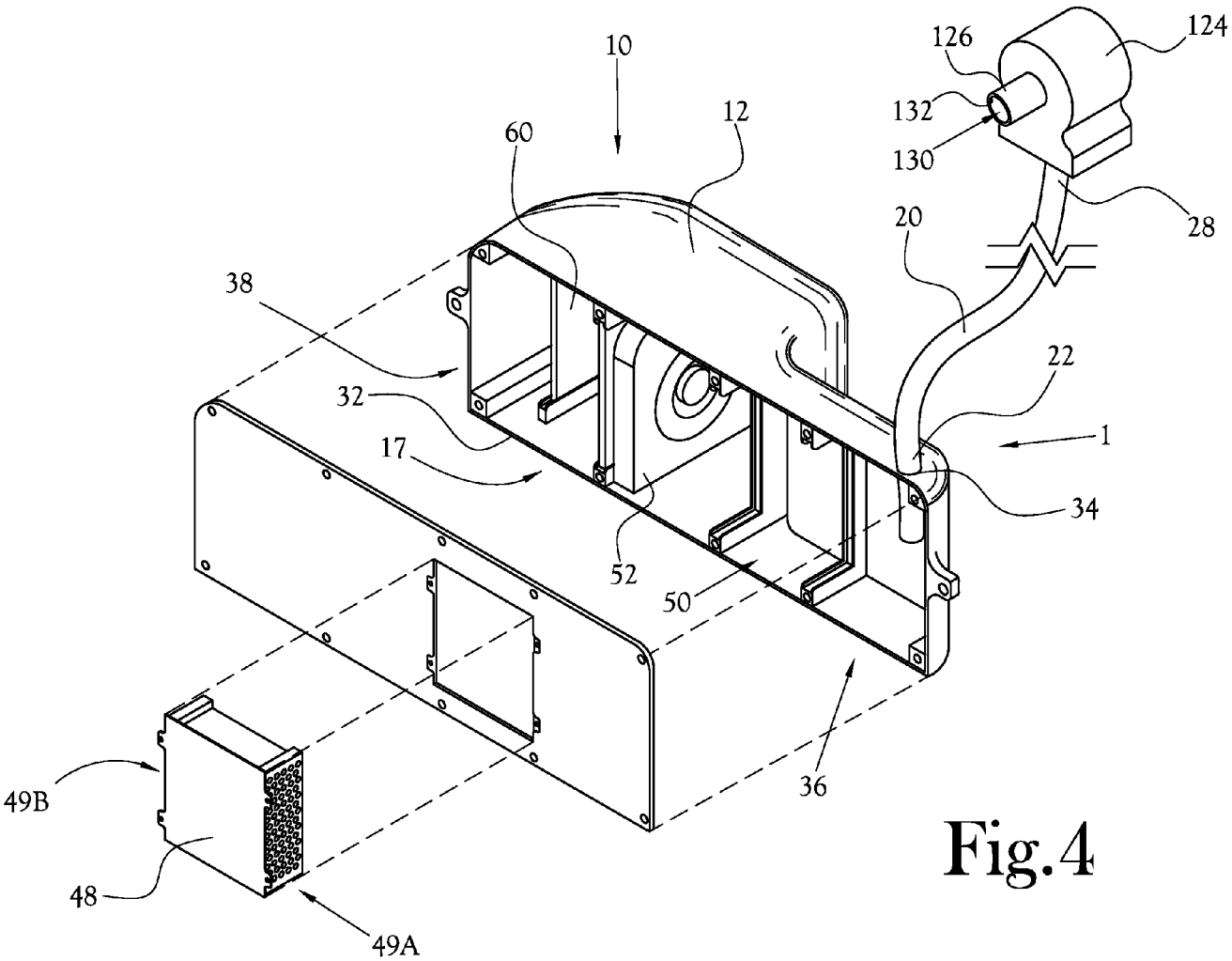
FIG. 4 illustrates an example embodiment of the present general inventive concept with the filter unit and rear panel of the housing exploded.
Figure 5:
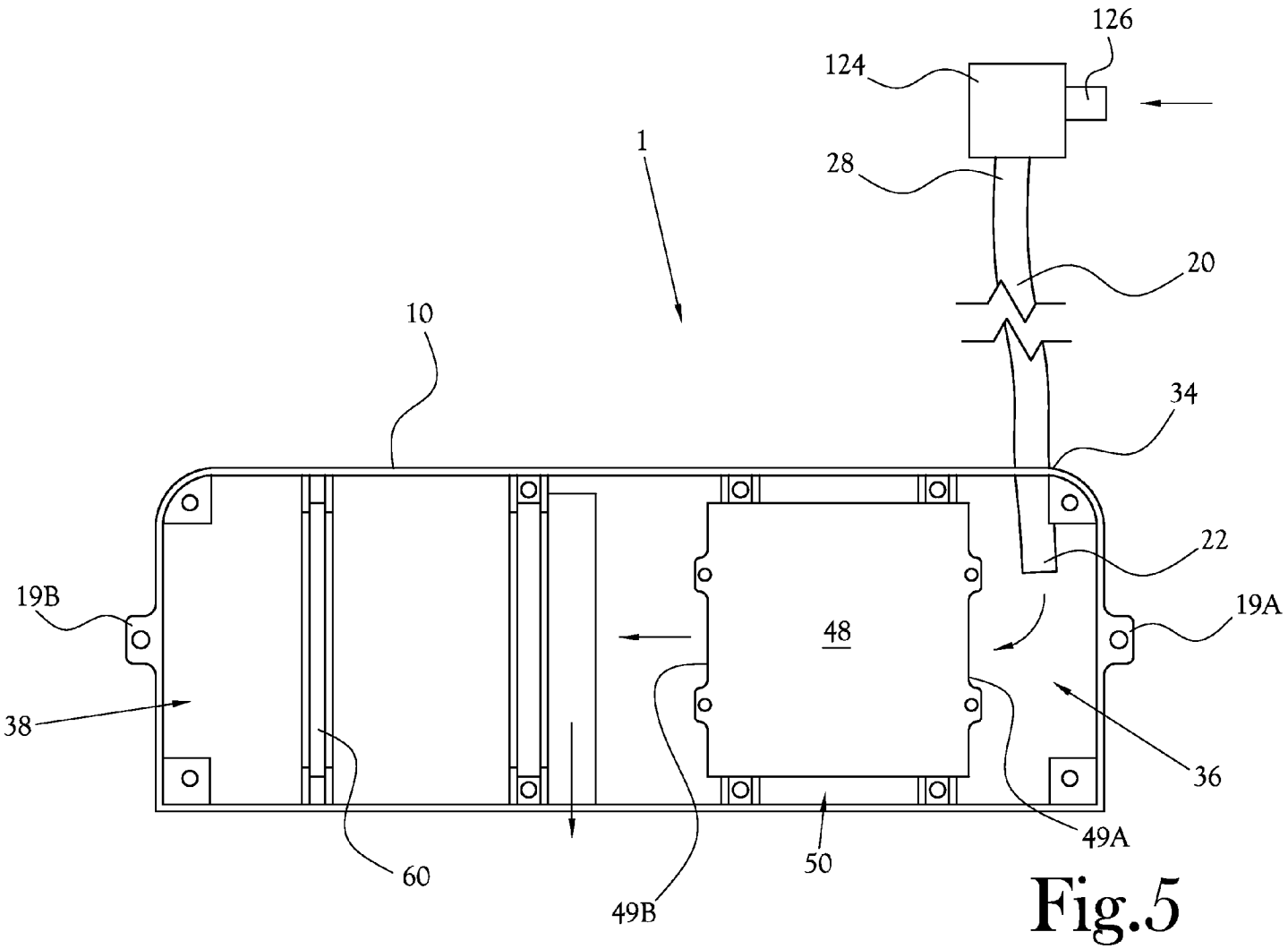
FIG. 5 illustrates an example embodiment of the present general inventive concept with direction arrows indicating the directional flow of the air passing through the air flow channel.

Referring to FIGS. 4-5, a filter cartridge or unit 48 is selectively and removably secured within a filter receptacle that is part of the housing 10. The filter cartridge 48 conditions the air for re-introduction into the outside environment. A filtration media is located within the filter cartridge 48. The filtration media is a material that, when disposed within the filter cartridge 48, filters out odors, bacteria, and/or particulate matter when air passes through it. It will be understood that particulate matter includes visible particles as well as matter not visible to the naked eye such as miniscule matter and bacteria. In some embodiments, the filtration media is a substance that traps and kills bacteria. In the illustrated embodiment, the filtration media is charcoal. Other embodiments can contain filtration media other than charcoal, and it will be understood that the present general inventive concept is not limited by the specific type of filtration media.

In some embodiments, a portion of the filter unit 48 is selectively removable to provide access to the inner volume of the filter unit 48 such that the filtration media can be added or removed and replaced. The filtration unit 48 contains an inlet 49A and an outlet 49B. The inlet 49A and outlet 49B each contain a plurality of openings sized to allow air to freely pass while substantially containing the filtration media within the filter unit 48. The filter unit 48 is mechanically disposed within the filter receptacle and can be selectively removed from the filter receptacle.

Figure 7:
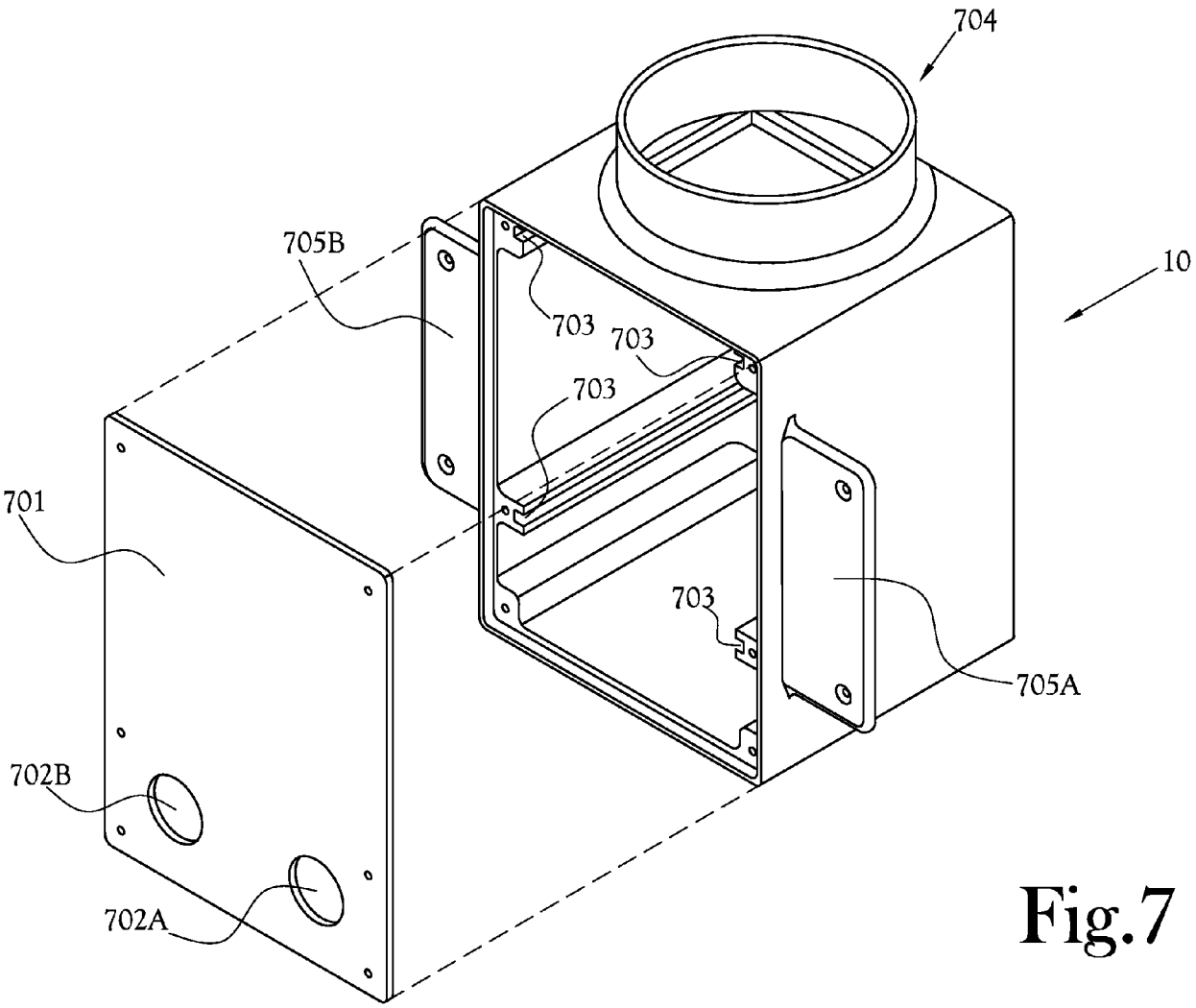
FIG. 7 illustrates an example embodiment of the housing included in the present general inventive concept for accommodating a fan assembly removed from, yet still in fluid communication with, the housing.
Figure 8:
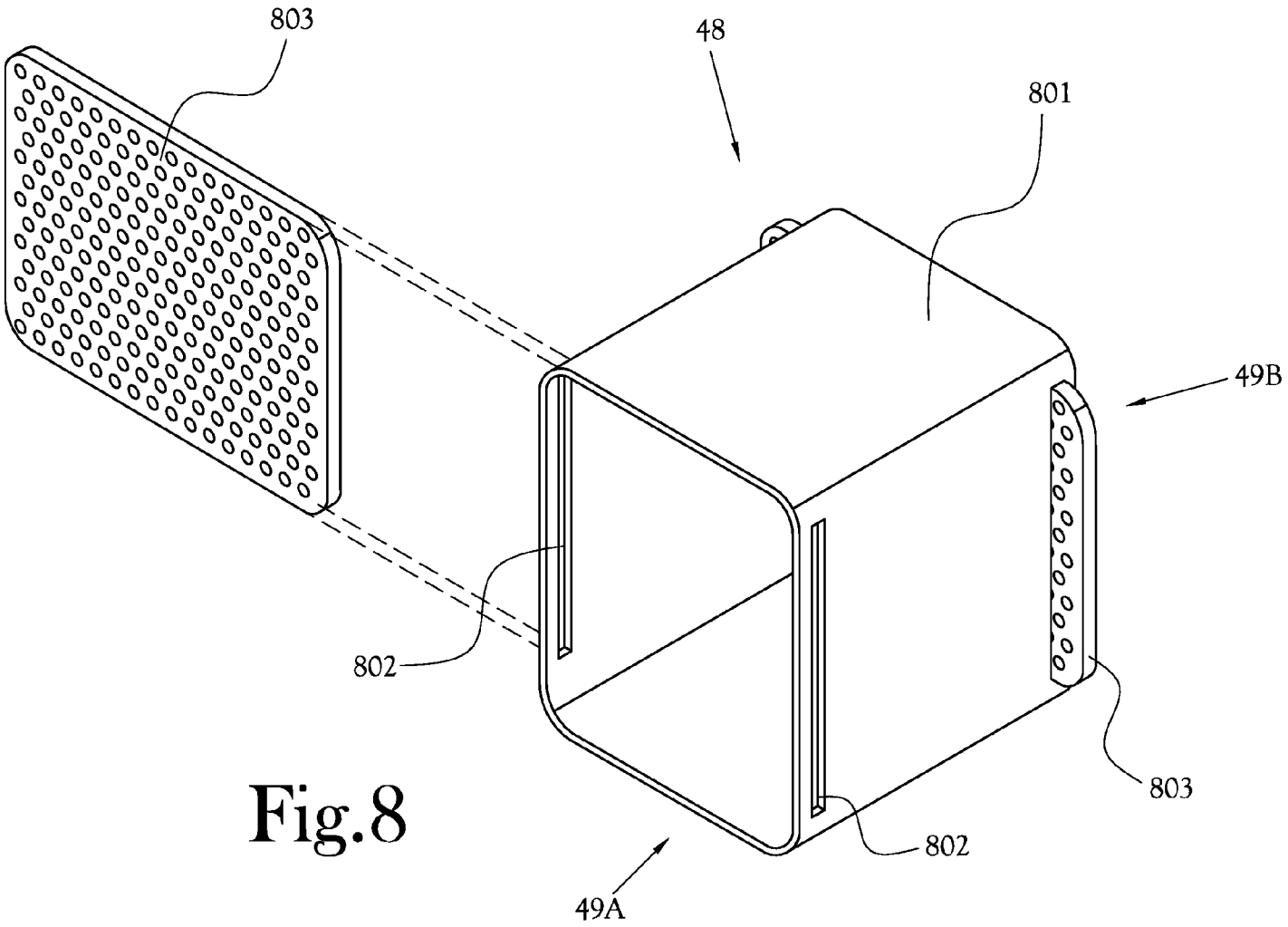
FIG. 8 illustrates an example embodiment of the filter cartridge included in the present general inventive concept.

Referring now to FIG. 8, an example filter cartridge in accordance with various embodiments of the present general inventive concept is shown. In some embodiments, a filter cartridge 48 is defined by a filter housing member 801, which can be produced, for example, by cutting a pipe to a preselected length; inserting slots 802 on opposing perimeter edges at both of the through openings; and sizing perforated screens 803 such that they may be slidably inserted into the slots 802 at the opposing perimeter edges of both through openings. The size of the perforations in the screens 803 can be any size as long as they allow for air to enter and exit the filter cartridge 48 while still substantially retaining filtration media there within. In the illustrated embodiment, the pipe used to produce the filter housing member 801 is plastic with a substantially square cross section. One skilled in the art will understand that the specific material and cross-sectional shape of the pipe can be substituted without departing from the scope or spirit of the present general inventive concept. In some embodiments, fasteners (not illustrated) are disposed in the perforated screens 803, immediately adjacent to the slotted, opposing perimeter edges, to secure the perforated screens 803 to the filter housing member 801. In some embodiments, the sides of the perforated screens 803 extend through the slots 802 of the filter housing member's opposing perimeter edges, and beyond the perimeter of the filter housing member 801. In accordance with this embodiment, the protruding screens 803 can engage with channels or grooves in the filter receptacle 50 to secure the filter cartridge 48 in the housing 10 (and/or 10', as in FIGS. 6, 7, & 9, further discussed herein).

Referring again to FIGS. 4 & 5, in order to maintain the position of the filter unit 48 within the housing 10, a filter receptacle 50 is provided. In the illustrated embodiment, the filter receptacle 50 is defined by a space in the wall of the housing 10 that receives the filter cartridge 48 and allows the filter cartridge 48 to be selectively and mechanically attached to the housing 10. In some embodiments, the filter cartridge 48 is selectively secured within the filter receptacle 50 by at least one fastener (not illustrated). In other embodiments, channels or grooves can be provided on the filter receptacle to accommodate mating tongue members on the filter unit, or vice versa, to slidably mount the filter cartridge to the filter receptacle. When the filter receptacle 50 receives the filter cartridge 48, a portion of the filter cartridge 48 is biased against the inner surface of the housing 10 such that when the fan assembly 52 is activated, substantially all of the moved air is directed through the filter cartridge 48. The filter receptacle 50 is dimensioned to minimize obstruction in the air flow, and is positioned to provide adequate support to inhibit the filter cartridge 48 from being pushed in either direction out of the airflow, while also accommodating easy removal and replacement thereof.

In the illustrated embodiments, the filter cartridge 48 is provided independent of the housing 10. Stated differently, the filter cartridge 48 can be selectively removable from the filter receptacle 50 as a single entity using, for example, a tongue-and-groove assembly. In other embodiments, the filter unit is comprised of the front 12 and rear 14 panels of the housing 10, along with perforated inlet and outlet panels that are selectively and mechanically disposed within the filter receptacle 50. That is, the filter unit 48 can be selectively removable from the filter receptacle 50 as a plurality of entities.

In some embodiments, a fan assembly 52 is provided within the housing 10 to draw air from within the toilet 72, through the conduit 20 to the interior volume 18 of the housing 10, and through the air flow channel, and the filter unit 48. After being filtered, the fan assembly 52 reintroduces the filtered air into the room environment through an exhaust port or outlet (not illustrated) defined in the bottom panel 32. In the embodiment illustrated in FIGS. 4-5, the fan assembly 52 interposes the inlet and exhaust ports of the housing 10, and more particularly, the fan assembly 52 interposes the filter receptacle 50 and the exhaust port of the housing 10.

Figure 6:
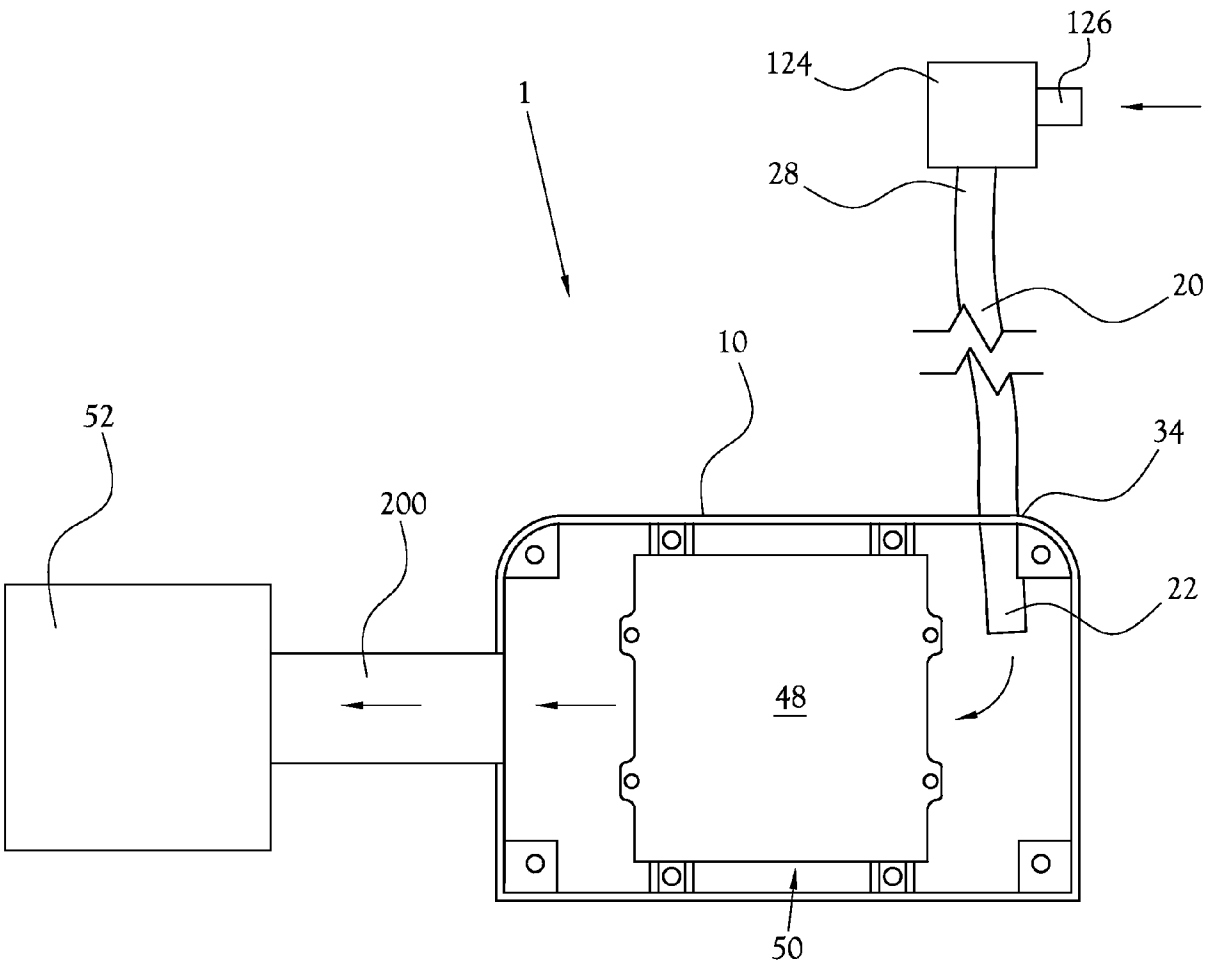
FIG. 6 illustrates an example embodiment of the present general inventive concept with the fan assembly removed from, yet still in fluid communication with, the housing.

In other embodiments, such as the example embodiments illustrated in FIGS. 6, 7 & 9, the fan assembly 52' can be located outside the housing 10' where the fan assembly 52' may be substantially similar to a central vacuum system or other similar, centrally located device for drawing air from a space. In that instance, the filtration system 1' can further define a fan receptacle 200 (in FIG. 6) in fluid communication with the fan assembly 52' and selectively connectable to the air flow channel in order to facilitate a fluid communication between the fan assembly 52' and the air flow channel. In some embodiments, a pre-existing fan assembly 52', such as a ceiling fan or exhaust system, is put in fluid communication with the air flow channel, via a fan receptacle 200, to draw air from the toilet bowl 72, through the conduit 20, and through the filter cartridge 48.

FIG. 7 illustrates an example embodiment housing 10' that accommodates a fan assembly 52' located outside of the housing 10'. The example housing 10' includes an access panel 701 for accessing the contents of the housing 10' and for engaging the one or more conduits 20 in fluid communication with the air flow channel. As illustrated, the access panel 701 includes two conduit receptacles 702A & 702B that engage the one or more conduits 20 extending from the ventilated toilet seat 76. Further included in the interior of the housing 10', is a filter receptacle 50 defined by installation grooves 703 for slidably installing a filter cartridge 48, as in FIG. 8. In the illustrated embodiment, the filter cartridge 48 is slidably installed in the filter receptacle 50 such that the filter cartridge 48 is biased against the sides of the housing 10' so that when the fan assembly 52' is activated, substantially all of the moving air passes through the filter cartridge 48. One skilled in the art will understand that the general present inventive concept is not limited to a filter cartridge 48 being secured within the filter receptacle by grooves 703. On the contrary, pins, screws, and other conventional fasteners can also be used without deviating from the scope or spirit of the present general inventive concept. The interior of the housing 10' and/or exterior of the filter cartridge 48 may also be lined with a sealing material, such as foam, to ensure that substantially all moving air passes through the filter cartridge 48. The illustrated example embodiment housing 10' also includes a fan receptacle receiver 704 to receive a fan receptacle 200 in fluid communication with a fan assembly 52'. Installation panels 705A & 705B are also included on the illustrated embodiment to facilitate installation on a wall or like structure. Conventional fasteners can be used to secure the installation panels 705A & 705B against the wall.

Figure 9A:
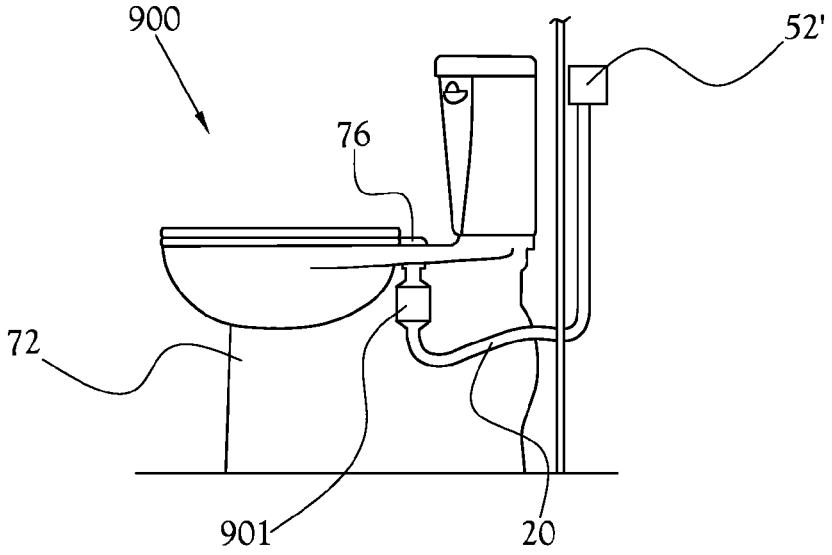
FIG. 9A illustrates an example embodiment filtration system that includes at least two filtration units and a fan assembly located outside of a housing unit.
Figure 9B:
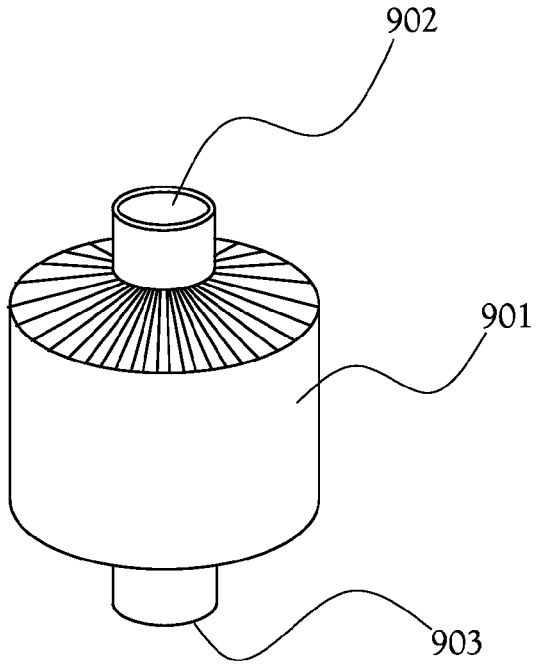
FIG. 9B illustrates an example embodiment filtration unit, as shown in FIG. 9A.

FIG. 9A illustrates an example embodiment filtration system 900 that includes one or more filtration housing units in fluid communication with a toilet bowl and a fan assembly. In the illustrated embodiment, the fan assembly 52' is located outside of the filtration housing unit 901, and placed in fluid communication with it by the fan receptacle 20. FIG. 9B illustrates an example embodiment filtration housing unit 901 that is included in the example embodiment filtration system 900 in FIG. 9A. Filtration unit 901 includes a filtration media interposing an inlet 902 and an outlet 903. When the filtration system is activated, air and particulate matter are received from the ventilated toilet seat 76 into the filter unit's inlet 902, through the filtration media, out the filtration outlet 903, into the conduit 20, where the air is drawn towards the fan assembly 52' and eventually exhausted outside the air flow channel. In one embodiment, the filtration unit 901 includes two inlets 902 in instances where the ventilated toilet seat 76 includes two evacuation channels. In an alternative embodiment where the ventilated toilet seat 76 includes two evacuation channels, the filtration system includes two filtration units 901, each of which may be used independently, or in conjunction with the other. It will be understood that the present general inventive concept can include a plurality of filtration units, as determined by sound engineering judgment.

Referring again to FIGS. 4 & 5, the fan assembly 52 is selectively actuated by a controller 60. In some embodiments, the controller 60 is disposed within the housing 10. For example, in the embodiment illustrated in FIG. 4, the controller 60 is disposed within the housing 10, adjacent to the fan assembly 52, distal the filter receptacle 50. In other embodiments, the controller 60 is disposed outside of the housing 10 (or 10', as in FIGS. 6, 7, & 9). It will be understood that the present general inventive concept is not intended to be limited by the specific location of the controller 60.

The controller 60 receives power from a power source and selectively directs power to the fan assembly 52 and/or 52'. For example, power can be provided from an external source through the use of a power cord. In other embodiments, power is provided internally with respect to the controller 60 such as, for example, with a battery. However, it will be understood that a variety of known or later developed means for powering the controller 60 and the fan assembly 52 and/or 52' may be effectively incorporated as well, such as, for example, solar power.

The controller 60 is configured to selectively activate and deactivate the fan assembly 52 and/or 52' for drawing contaminated air through the air flow channel according to various selection criteria. For example, an activation switch can communicate with the controller 60 to initiate or cease operation of the fan assembly 52 and/or 52' according to predetermined conditions. The activation switch can be located on or in the housing unit 10 or 10' or may be located externally, such as, for example, on a remote control. Alternatively, there can be an external condition activation switch whereby an external condition, for example, turning on or off a light switch, causes the activation switch to communicate with the controller 60 and initiate or cease operation of the fan assembly 52 and/or 52'. In some embodiments the external condition activation switch is influenced by a light sensor that selectively communicates to the controller 60 to initiate operation of the fan assembly 52 and/or 52' when the room environment is lit and subsequently deactivate the operation when the room environment is dark. In other embodiments, the external condition activation switch can be influenced by a pressure sensor proximate the ventilated toilet seat 76. In yet other embodiments, the external condition activation switch can be influenced by a motion sensor proximate the ventilated toilet seat 76, to activate and/or deactivate the fan assembly 52 and/or 52' according to a signal of the sensor.

In the illustrated embodiment of FIGS. 4-5, in order to provide access to the fan assembly 52, the rear panel 14 of the housing unit 10 is selectively removable. At least one removable fastener can be provided for securing the back panel to the remainder of the housing 10. Also, in order to provide further access to the fan assembly 52 and controller 60, a selectively attachable access panel (not illustrated) can be defined within the bottom panel 32. The access panel can be mechanically attachable to the bottom panel 32. It will be understood that other means of access to the interior volume 18 of the housing 10 may be provided as well.

From the foregoing description, it will be recognized by those skilled in the art that a filtration system for use with a ventilated toilet seat assembly offering advantages over the prior art has been provided. In accordance with various embodiment of the present general inventive concept, a filtration system for removing odors, bacteria, and/or particulate matter from air from a toilet bowl can include an air flow channel partially defined by a housing unit having a filter receptacle located therein. The air flow channel can be further defined by a conduit comprising a proximal end and a distal end, the distal end secured adjacent to the toilet bowl, the proximal end in fluid communication with the housing. A connector can be selectively secured to the proximal end of the conduit, to mechanically secure the conduit to the housing in a substantially air tight engagement.

The filtration system can further include a toilet seat hinge to rotatably connect a toilet seat to the toilet bowl between an elevated and down position, the toilet seat hinge comprising an intake portion and an exhaust portion, the intake opening to the toilet bowl, the exhaust portion secured to the distal end of the conduit, the intake portion having an elliptical member to resistively hold the toilet seat in the elevated position when the toilet seat is raised, and to freely release the toilet seat when the toilet seat is lowered to the down position. In one embodiment, the intake portion comprises an inlet disposed on one end of the elliptical member. In one embodiment, the exhaust portion comprises an exhaust post having an exhaust disposed on a distal end thereof, the exhaust post securing a ventilated toilet seat to a toilet and receiving the distal end of the conduit.

A filter cartridge comprising an interior volume to receive filtration media, an inlet, and an outlet, can be located within the housing unit. The filter cartridge is secured within the filter receptacle, and the inlet and the outlet each define a plurality of openings sized to permit air containing odors and particulate matter to enter and exit the filter cartridge interior while substantially preventing the filtration media from exiting the filter cartridge interior. A filtration media can be contained within the filter cartridge interior volume to collect odors and particulate matter and trapping and killing bacteria when the air passes through the filtration media. In one embodiment, the filter cartridge is selectively secured within the filter receptacle by a fastener.

A fan assembly can be placed in fluid communication with the toilet bowl, further defining the air flow channel. When activated, the fan assembly draws air from the toilet bowl through the intake portion of the toilet seat hinge, through the exhaust portion of the toilet seat hinge, though the conduit into the housing, the fan assembly moving the air in the air flow channel into the filter cartridge inlet, through the filtration media, and out of the filter cartridge outlet, the fan assembly exhausting filtered air from the filtration system. In some embodiments, the system includes a plurality of filtration units.

In one embodiment, the fan assembly is located within the housing unit. In another embodiment, the fan assembly is in fluid communication with the air flow channel but is located outside of the housing and includes a fan receptacle to place the fan assembly in fluid communication with the air flow channel.

Further included in some embodiments of the present general inventive concept is a controller that selectively activates the fan assembly; and an activation switch communicating with the controller to selectively activate or deactivate the fan assembly. In one embodiment, the activation switch is located on or in the housing. In another embodiment, the activation switch is located externally with respect to the housing, such as, for example, on a remote control device. In one embodiment, the activation switch is influenced by a light sensor. In another embodiment, the activation switch is influenced by a motion sensor. In yet another embodiment, the activation switch is influenced by a pressure sensor.

Additionally, the general present inventive concept includes a method for filtering air and particulate matter from a ventilated toilet seat. In one embodiment, the method includes placing a ventilated toilet seat in fluid communication with a fan assembly using one or more conduits to create an air flow channel; interposing a filtration unit between the fan assembly and the toilet seat such that the filtration unit is contained within the air flow channel; providing a controller to selectively provide power to the fan assembly, as determined by an activation switch; and activating the fan assembly such that the air in an around the toilet bowl is pulled through the ventilated toilet seat, into the filtration unit, and exhausted out of the air flow channel.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While example embodiments of the present general inventive concept have been shown and described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the scope or spirit of applicant's general inventive concept.

What is claimed is:

1. A filtration system to filter air from a toilet bowl comprising:

a housing having an inlet port and an exhaust port, said housing including a filter receptacle having a guide member interposing said inlet port and said exhaust port to mate with a mating portion of a filter unit, the mating portion including one or more protrusions extending from opposing surfaces of the filter unit to mate with the filter receptacle, such that an inlet side of the filter unit is secured a predetermined distance away from the inlet port;

a conduit comprising a first end and a second end, said first end securable adjacent to a toilet bowl, said second end connected to said inlet port;

a fan assembly in fluid communication with said toilet bowl such that said filtration system defines an air flow channel to draw air from said toilet bowl through said conduit into said inlet port, through said filter unit, and through said exhaust port; and a controller to selectively activate said fan assembly.

2. The filtration system of claim 1, further comprising a ventilated toilet seat pivotally coupled to the toilet bowl by a toilet seat hinge, the toilet seat hinge including an inlet portion to engage with said toilet seat and an exhaust portion in fluid communication with the air flow channel to deliver air from an underside of the ventilated toilet seat to the air flow channel.

3. The filtration system of claim 2, wherein said toilet seat includes an intake to receive said toilet seat hinge, said intake in fluid communication with the toilet bowl;

hereby said fan assembly, when activated, draws air from said toilet bowl through said toilet seat hinge and into said air flow channel.

4. The filtration system of claim 1, further comprising:

a filter unit that is removably secured within the filter receptacle; and a filtration media contained within an interior volume of said filter unit, said filtration media to collect odors, bacteria, particulate matter, or any combination thereof when air passes through said filtration media.

5. The filtration system of claim 4, wherein said filtration media traps and kills bacteria that enter the filter unit.

6. The filtration system of claim 1, wherein said fan assembly is interposing said inlet port and said exhaust port of said housing.

7. The filtration system of claim 1, further comprising a fitting having a first part coupled to said conduit and a second part coupled to said housing, said first part and said second part cooperatively mating to secure said conduit to said housing in a substantially air tight engagement.

8. The filtration system of claim 7, wherein said fitting is a connector that is selectively coupled to said conduit, to said housing, or both.

9. The filtration system of claim 1, wherein a fitting is provided to said conduit and said housing.

10. The filtration system of claim 1, wherein said received filter unit includes an inlet and an outlet such that air is drawn from the toilet bowl through said conduit, through said inlet port of said housing, into said filter unit inlet, through said filter unit outlet, and out said exhaust of said housing.

11. The filtration system of claim 10 wherein said received filter unit inlet and outlet define a plurality of openings sized to permit air containing odors and particulate matter to enter and exit said filter unit's interior while substantially preventing said filtration media from exiting said filter unit's interior.

12. The filtration system of claim 10, wherein said filter unit includes a sealing material on an exterior surface thereof, and said housing includes a sealing material on an interior surface thereof to receive said filter unit in a manner such that substantially all moving air travels through said filter unit.

13. The filtration system of claim 1, wherein said fan assembly is located outside said housing.

14. The filtration system of claim 13, wherein said air flow channel is further defined by a fan receptacle, said fan receptacle is selectively connectable to said housing and to said fan assembly.

15. The filtration system of claim 14, wherein said fan assembly is a pre-existing fan assembly.

16. The filtration system of claim 1, further comprising an activation switch, said activation switch communicating with said controller to selectively activate or deactivate said fan assembly.

17. The filtration system of claim 16, wherein said activation switch is located on or in said housing.

18. The filtration system of claim 17, wherein said activation switch is located on a remote control.

19. The filtration system of claim 17, wherein said activation switch is influenced by a light sensor, a motion sensor, a pressure sensor, or any combination thereof.

20. A filtration system to filter air from a toilet bowl comprising:

a fan assembly having an air flow channel in fluid communication with a toilet bowl;

a housing enclosing said fan assembly, said housing having a filter receptacle configured to receive and position a filter unit therein such that an open space is provided on both sides of the filter unit, the filter unit including one or more protrusions extending from opposing surfaces of the filter unit to mate with the filter receptacle to form a friction seal between the filter receptacle and the one or more protrusions, said filter unit being in fluid communication with said air flow channel; and a controller to selectively activate said fan assembly such that, when activated, said fan assembly draws air from said toilet bowl and through said filter unit to exhaust said air out of said air flow channel.

21. The filtration system of claim 20, wherein the housing is configured with an open portion that is closed by the filter unit when the filter unit is installed in the filter receptacle.

22. A filtration system to filter air from a toilet bowl comprising:

a housing having an inlet port and an exhaust port, said housing having an open portion to receive a filter unit, the open portion being configured with a filter unit mating portion to mate with the filter unit to secure the filter unit in place in an air flow channel inside the housing, the open portion including a receptacle on an exterior surface of the housing to receive a securing portion disposed on a back surface of the filter unit such that when the filter unit is installed in the open portion, the back surface of the filter unit defines a closure of the open portion;

a fan assembly provided in the housing to draw air from a toilet bowl into the inlet port, through the filter unit, and out of the exhaust port.

* * * * *